United States Patent [19]

Farley

[11] Patent Number: 4,724,980

[45] Date of Patent: Feb. 16, 1988

[54] METHOD AND APPARATUS FOR METERING MATERIAL INTO AN AIR FORMING SYSTEM

[75] Inventor: Radcliffe W. Farley, Worcester, Pa.

[73] Assignee: Allied Corporation, Morristown, N.J.

[21] Appl. No.: 939,958

[22] Filed: Dec. 10, 1986

[51] Int. Cl.[4] ..... B67D 5/08

[52] U.S. Cl. ..... 222/55; 222/71; 177/121

[58] Field of Search ..... 222/55, 56, 52, 59, 222/63, 71, 77, 415; 177/121; 198/577, 571, 570

[56] References Cited

U.S. PATENT DOCUMENTS

| | | | |
|---|---|---|---|
| 2,637,434 | 5/1953 | Harper | 222/55 |
| 3,165,195 | 1/1965 | Sass et al. | 222/55 |
| 3,407,656 | 10/1968 | Chadenson et al. | 222/55 |
| 3,412,699 | 11/1968 | Culp et al. | 222/55 |
| 3,957,126 | 5/1976 | Hobart | 177/121 |

OTHER PUBLICATIONS

Haigh-Chadwick Ltd. Product Information Leaflet, "MICROWEIGH".

*Primary Examiner*—Joseph J. Rolla
*Assistant Examiner*—Kenneth Noland
*Attorney, Agent, or Firm*—Ken C. Decker; W. N. Antonis

[57] ABSTRACT

Fibers or other bulk material to be conveyed into an air forming system are fed in a continuous stream at a uniform rate to the air forming system by conveying the material into an elongated weight pan, weighing the pan, dropping the material onto a conveyor, and adjusting the speed of the conveyor to compensate for variations in weight. After a target weight in the pan is achieved, material is no longer fed into the pan, but the pan is not dumped until the conveyor has moved at least a distance equal to the length of the pan. The conveyor is at least twice as long as the pan, so that two dumps of the pan can be accommodated on the belt at the same time, thereby permitting the speed of the belt to be adjusted to feed the material into the air forming system at a substantially constant rate.

15 Claims, 3 Drawing Figures

METHOD AND APPARATUS FOR METERING MATERIAL INTO AN AIR FORMING SYSTEM

This invention relates to a method and apparatus for metering material such as fibers, fibers into an air forming system.

Nonwoven textile batts have many uses; for example such batts are used as disposable diapers, sanitary pads, and more recently have been proposed for use as a filtering media. Such batts are commonly manufactured from a combination of fibers. When used as a filtering media, such batts may contain wood pulp fibers and other staple refractory and/or textile fibers, such as fiberglass, nylon, etc. However, in order to make acceptable batts of fairly consistent quality, it is necessary to feed the fibers or other material into the air forming machine continuously and at a substantially constant rate.

Air forming machines are available from several suppliers. For example, the air forming machine disclosed in U.S. Pat. No. 4,352,649 has the advantage of permitting fibers to remain in an air stream until the batt is laid, but suffers the disadvantage that there is no way to meter textile fibers into the system. Accordingly, this type of machine has heretofor been used to manufacture batts from wood pulp fibers, which ara avilable in sheet form and are inherently self-metering when feed to an appropriate hammermill to open the fibers. The other type of air laying machine, such as that illustrated in U.S. Pat. No. 3,918,126, is capable of handling fibers in sheet form, such as the aforementioned wood pulp fibers, and is also capable of handling fibers in bulk form. When handling fibers in bulk form, this type of machine first conveys the fibers to feed rollers which compress the fibers into a feed mat. The difficulty with this type of apparatus is that the fibers must be repeatedly handled, and are forced into and removed from the air stream during formation of the batt. Since repeated handling of fibers often damages the fibers, it is desirable to provide an air forming apparatus with appropriate metered feed that requires minimum handling of the fibers.

The present invention meters material into an air forming system at a substantially constant rate by controlling both the weight of the material fed into a weigh pan, dumping the material onto a moving conveyor belt that carries the material into the air forming system, and by compensating for weigh variations by adjusting the speed of the conveyor. Accordingly, material is fed into the air forming system at a substantially constant metered rate. Although the device is particularly adapted for feeding material into an air forming system, it is also adaptable to feeding other material not in fiberous form into such an air forming system.

These and other advantages of the present invention will become apparent from the following description, with reference to the accompanying drawings, in which FIG. 1 is a front elevational view of a metering apparatus made pursuant to the teachings of my present invention;

Figure 2:
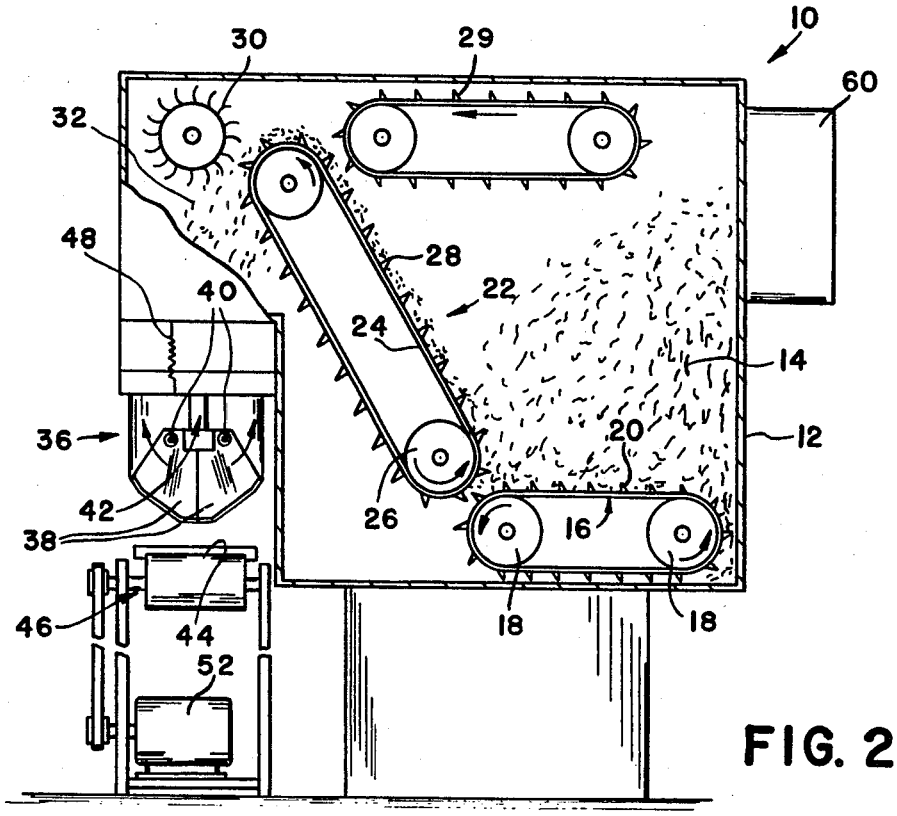
FIG. 2 is a view taken substantially along lines 2—2 of FIG. 1.

Referring now to the drawing, machine 10 includes a housing 12 that defines a hopper 14 therewithin for receiving fibers or other material to be metered by the machine. A horizontal conveying apron 16 is mounted on powered rollers 18 and conveys the material to an elevating apron generally indicated by the numeral 22. The elevating apron 22 includes a belt 24 mounted on powered rollers 26 and carrying spikes 28 for conveying material upwardly viewing FIG. 2. If a brush 30 which is powered for rotation in the direction indicated knocks the material off the of apron 22 and into a channel generally indicated by the numeral 32. If the material remains in clumps on the belt 24, another spiked belt 29, moving in the direction indicated, separates the clumps into smaller tufts, some of which return to the hopper 14 by the action of the belt 29, while other tufts remain on conveying apron 16.

The material dropped into the channel 32 drop downwardly into an elongated weigh pan 36, the bottom of which is defined by two trap doors 38 which pivot about corresponding pivots 40. An electro-pneumatic actuator 42 is responsive to an electrical signal to plunge downwardly viewing FIG. 2, thereby pivoting the doors 38 in the direction indicated by the arrows about the pivots 40, thereby causing the fibers, etc. deposited in the hopper 36 to drop upon the upper race 44 of an endless conveyor generally indicated by the numeral 46. Strain gauges 48 are provided to provide a continuous weighing of the pan 36 so that the weight of the material being deposited in the pan can be continuously monitored.

Figure 1:
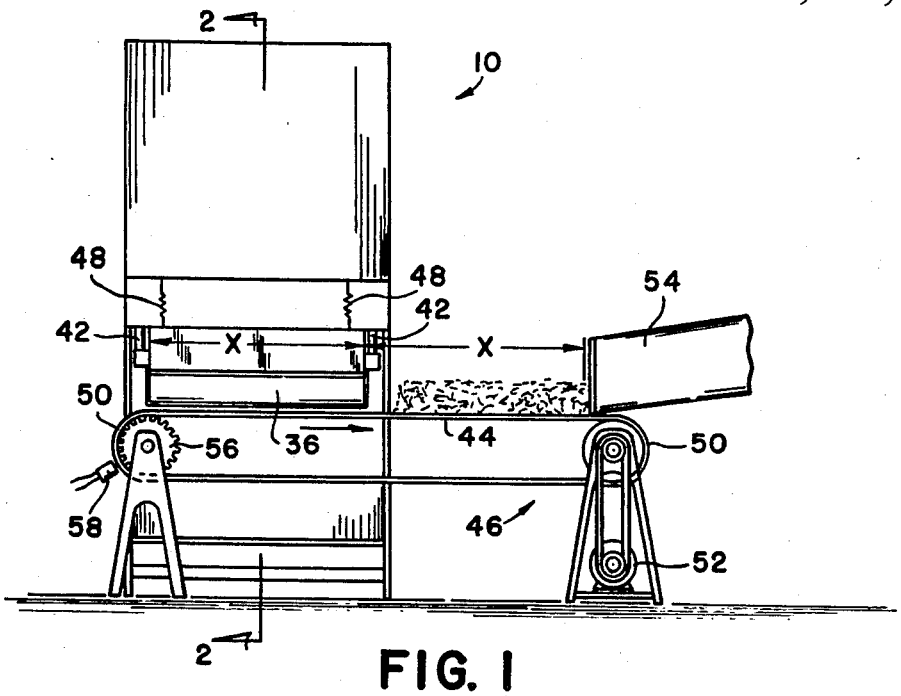

The conveyor 46 is mounted on powered rollers 50 and is operated by a variable speed motor 52. As can best be seen in FIG. 1, the pan 36 is supported above the race 44 of the conveyor 46 has a length along the race of the conveyor indicated by the quantity "x" in FIG. 1. The upper race 44 has a length of approximately two times the distance x, as also indicated in FIG. 1, so that the fibers or other material can be dumped on the upper race 44 (which moves in the direction of the arrow in FIG. 1) and remain on the upper race 44 while the pan 36 is being filled for a second dump. The inlet of a tube 54 is located at the end of the belt 46. The tube 54 connects with a conventional air forming machine (not shown). One of the rollers 50 is provided with a toothed tone wheel 56 which is provided with circumferentially spaced teeth. Since the tone wheel 56 rotates with its corresponding roller 50, the teeth of the tone wheel 56 generate a varying magnetic pulse in an electromagnetic pickup 58 which is mounted adjacent the tone wheel 56. Accordingly, as is well know to those skilled in the art, by counting the pulses generated by the teeth of the tone wheel in the electromagnetic pickup 58, the distance that the conveying belt 46 has traveled can be determined. By dividing the number of teeth counted by time, the speed of the belt can also be determined.

A conventional microprocessor is mounted in a control panel 60 mounted on the backside of the machine 10. The microprocessor has appropriate inputs for receiving the data generated by the electromagnetic pickup 58 and the strain gauges 48, and has corresponding outputs for sending a speed signal regulating the variable speed motor 52 to the desired speed and still another output for actuating the electro-pneumatic actuators 42 to cause the doors 38 of the pan 36 to swing open. Accordingly, the control unit 60 has stored within memory at any given time during the operation of the machine data which is indicative of the instantaneous speed of the conveyor 46, the distance that the upper race 44 has traveled since the last time that the contents of the pan 36 were dumped into the conveyor, and the weight of the material in the pan 36 as measured by the strain gauges 48. The microprocessor contained within control panel 60 is also capable of generating output signals at any given time to regulate the speed of the variable speed motor 52 and also to actuate the electromagnetic actuator 42. The microprocessor in panel 60 also includes an output for starting and stopping the elevating apron 22, which is powered by a conventional electric motor (not shown).

Figure 3:
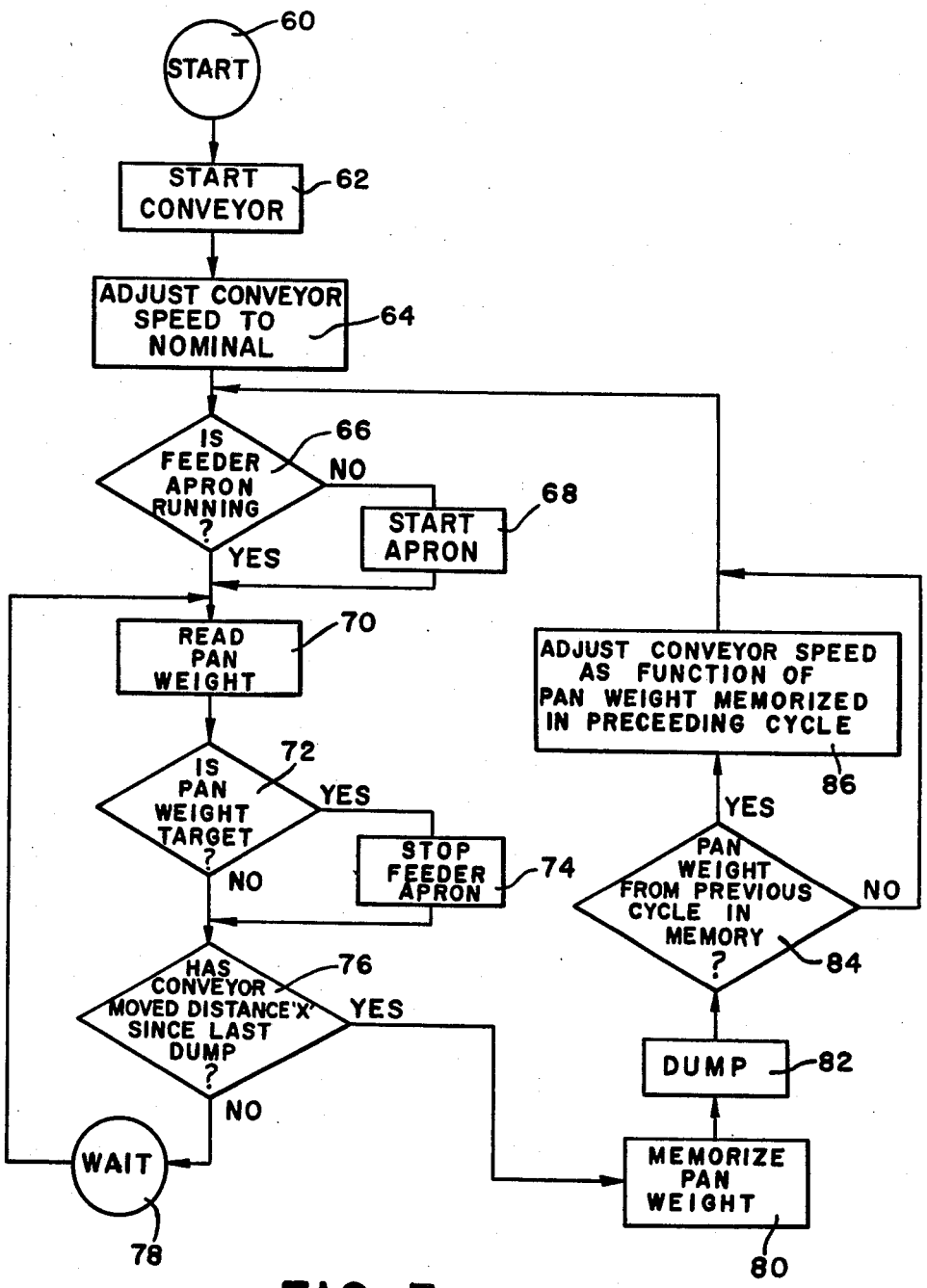
FIG. 3 is a diagrammatic illustration of the control logic used in the invention.

Referring to FIG. 3, the logic diagram pursuant to which the microprocessor was programmed is illustrated. When the machine is started, as indicated in the circle 60, the conveyor 46 is started pursuant to the block 62. The microprocessor then adjusts the speed of the conveyor to some nominal speed programmed within the microprocessor, pursuant to block 64. The logic then procedes to inquire, pursuant to block 66, as to whether the elevating apron 22 is running or not, if not; the apron 22 is started pursuant to block 68. If the apron is already running, the program procedes to he block 70, which causes the microprocessor to read the weight of the material in he pan as measured by the strain gauges 48. Of course, upon starting of the elevator apron 22, the material will be conveyed upwardly and then are dropped downwardly through the channel 32. However, the material is almost never fed to the pan 36 at a uniform rate, because of the quantity and weight of the material in he hopper 14 may vary, and also because some of the material (a varying percentage, depending upon the particular material used) will be in clumps, and will not be brushed off the elevating apron 22 by the brush 30. Of course, repeated handling of the material by the apparatus tends to break the clumps apart so that eventually the material may be usable, but it is impossible to predict a given pan weight upon running of the apron for any predetermined given time.

The weight of the material in he pan is then compared in decision block 72, with a predetermined target weight stored in the memory of the microprocessor. If the weight of the material in the pan is greater than the target weight, the elevating apron 22 is stopped pursuant to block 74. In any event, the microprocessor then compares the distance that the belt 46 has moved since the last dump (or the distance that it has moved since the machine has started), as measured by the electromagnetic pickup 58. This comparison is made in the decision block 76. If the distance that the conveyor has moved since the last dump (or the distance it has moved since the machine was started, in the case of the first dump) is less than the distance "x" (which represents the length of the weigh pan 36 suspended over the race 44), the program waits, pursuant to circle 78, for the remaining cycle time of the microprocessor and then repeats blocks 70, 72 and 76 until the upper race 44 has moved the distance "x". When this occurs, the weight of the material in the pan are memorized pursuant to blok 80. The program then causes, pursuant to block 82, the actuator 42 to dump the contents of the pan onto the upper race 44 of the conveyor 46. The microprocessor then checks its memory to determine if a weight has been memorized for a preceding dump, pursuant to decision block 84. It is important to note that the memorized weight for which the decision block 84 checks is not the weight of the pan that has been dumped on this cycle; instead, the weight for which the decision block 84 checks is the weight of the dump for the preceding cycle, that is, the cycle just before the cycle in which the weight of the pan has just been memorized. If there is no such previous weight in the memory (in other words, if the current dump was the first dump after starting the machine), the program branches directly back to decision block 66. If there is a weight from the previous cycle in memory, the microprocessor transmits a signal to the controller for the variable speed motor 52 to either speed up or slow down the speed of the conveyor 46, to compensate for the difference in weight between the preceding cycle and the cycle before that. The adjustment is made pursuant to block 86 of the diagram of FIG. 3.

Although elevating apron 22 is stopped when the target weight of the pan 36 is achieved, the weight of the pan may exceed the target weight because of airborn material in the channel 32 settling into the pan 36 after the apron 22 is stopped. Although not illustrated in FIG. 3, an optional feature may be programmed into the program that memorizes the weight of several successive dumps. If all of these dumps are overweight, the target weight is reduced by the same percentage as the average amount that the dumps have been overweight. Accordingly, the program assumes that the original target weight will be attained using the reduced target weight, because of the settling of the material from the airstream into the pan 36 after the apron 22 is stopped.

Referring to FIG. 1, two dumps of the pan 36 may be accommodated on the upper race of conveyor 46 before the material on the conveyor 46 enters the inlet tube 54. Assume now that the machine is just being started. The conveyor 46 is set to run at some nominal speed, and the pan 36 is then filled by operation of the elevating apron 22 as discussed hereinabove. Assuming that the target weight is achieved before the conveyor has moved the distance x, the conveying apron is stopped and the machine waits until the conveyor does move the distance x. The contents of the pan 36 are then dumped onto the conveyor 46. However, since this was the first dump after starting the machine, there is no material on the portion of the upper race 44 to the right of the pan in viewing the figure. Accordingly, no material enters the tube 54.

As the material is being conveyed to the right viewing FIG. 1, the pan 36 is again filled by operation of the elevating apron. When the conveyor again moves the distance x, the material from the preceding dump has been carried to that portion of the belt to the right of the pan. At this time, the contents of the pan are again dumped on the belt. It is important to note that, up to this time no material has been conveyed into the tube 54. At this time, the microprocessor checks its memory and finds pursuant to decision block 84 that the weight of the material which has now moved to the portion of the belt to the right of the pan 36, viewing FIG. 1 has been stored in memory. The microprocessor also determines that the target weight had been achieved on this dump, and, accordingly, no changes in the speed of the conveyor are necessary to feed the material at a constant rate into the tube 54. At this time, the material starts to feed into the tube 54, and the material from the second dump is being carried to the right to replace the material conveyed into the tube 54 from the first dump. Simultaneously, the elevating apron 22 fills the pan 36 for a third time.

When the conveyor has again moved the distance x, the pan is again dumped. At this time, the material from the second dump begins to feed into the tube 54. If the material for the second dump did not attain the target weight before the conveyor had moved the distance x for that dump pursuant to decision block 76, a "short" weight would have been stored into memory for the second dump. Accordingly, if the speed of the belt were not changed, the rate that the material is fed into the tube 54 from that dump would be lower than the rate material from the previous dump is fed. However, pursuant to block 86, the speed of the belt is then increased to compensate for the short weight and to thereby assure that the material is fed into the tube 54 at a substantially constant rate.

Conversely, if the dump was over the target weight (due, for example, to settling of airborn material in the pan after the belt has been stopped), the speed of the belt is decreased proportionally. Accordingly, material is fed in a continuous stream at a substantially constant metered rate.

We claim:

1. Method of metering material into an air forming system comprising the steps of conveying the material into a pan, weighing the material in the pan, transferring the matrial from the pan to a moving conveyor along a predetermined length of said conveyor for conveying the material to the inlet of the air forming system, discontinuing transfer of said material to the conveyor while advancing the conveyor said predetermined length, conveying additional material into said pan after transferring material from said pan to said conveyor, and again transferring material from said pan to said conveyor when the conveyor has been advanced said predetermined length, and adjusting the speed of the conveyor as a function of the weight of the material transferred to the conveyor and being conveyed into the air forming system.

2. Method of metering material as claimed in claim 1, wherein the step of conveying material into the pan is terminated when the weight of the pan attains a predetermined target weight.

3. Method of metering material as claimed in claim 1, wherein the step of adjusting the speed of the conveyor effects adjustment of the conveyor speed on the basis of the weight of the material transferred to the conveyor on a transfer cycle preceeding the cycle in which the weight of the material transferred to the conveyor is being established.

4. Method of metering material as claimed in claim 1, wherein said material is transferred to the conveyor by dropping the material from an elongated pan suspended over the conveyor.

5. Method of metering material as claimed in claim 4, wherein said conveyor has a length at least twice the length of said hopper whereby material from two dump cycles is accommodated on said conveyor, the material from the preceeding dump cycle being transferred away from said hopper when the material from the next dump cycle is transferred into the pan, the speed of the conveyor being adjusted as a function of the weight of the material being conveyed into said air forming system.

6. Method of metering material as claimed in claim 1, wherein said pan has a length equal to said predetermined length, said pan being suspended over said conveyor with the length of the pan oriented along the direciton of movement of the conveyor, said material being transferred from the pan to the conveyor by dumping the contents of the pan onto the conveyor.

7. Method of metering material as claimed in claim 6, wherein said pan has side walls and a bottom wall defining an open upper surface, said material being conveyed into said pan through said open upper surface, said material being transferred to said conveyor by opening the bottom of said pan.

8. Apparatus for metering material into an air forming system comprising a housing, a pan supprted on said housing means for transferring material to the pan, means for measuring the weight of the material in the pan, an endless moving conveyor belt for receiving the material from the pan and conveying it to said air forming system, said pan having a predetermined length aligned with the direction that the conveyor belt conveys material and including means for transferring the material from the pan to the belt, and control means for transferring the contents of the pan to the conveyor belt each time the conveyor belt moves a distance equal to the predetermined length and for controlling the speed of the belt so that the material is transferred from the belt to the air forming system at a substantially constant rate.

9. Apparatus for metering material as claimed in claim 8, wherein said conveyor belt is long enough to accommodate material transferred from the pan in a current cycle and in at least one preceeding cycle, said control means including means for recording the weight of the material transferred from the pan to the conveyor in both of said cycles, said control means controlling the speed of said conveyor belt as a function of the weight of the material transferred to the conveyor belt on said preceeding cycle.

10. Apparatus for metering material as claimed in claim 9, wherein said control means includes means for interrupting said means for transferring material from said hopper to the pan when the weight of the material in the pan attains a predetermined level.

11. Apparatus for metering material as claimed in claim 9, wherein the race of said conveyor belt facing the pan being at least twice the length of the pan.

12. Apparatus for metering material as claimed in claim 11, wherein said control means controls the speed of the conveyor belt as a function of the weight of the material on that portion of the belt not under said pan.

13. Apparatus for metering material as claimed in claim 12, wherein said control means includes means for weighing the material in the pan, means for memorizing said weight, means for measuring the distance traveled by said conveyor belt, and means for adjusting the speed of said conveyor belt as a function of said memorized weight but only after the conveyor belt travels a distance equal to the length of the pan.

14. Apparatus for metering materials as claimed in claim 8, wherein said pan is suspended over said conveyor with the length of the pan oriented along the direction of movement of the conveyor, said material being transferred from the pan to the conveyor by dumping the contents of the pan onto the conveyor.

15. Apparatus for metering material as claimed in claim 14 wherein said pan has side walls and a bottom wall defining an open upper surface, said material being conveyed into said pan through said open upper surface, said bottom including activating doors for opening to dump said material onto said conveyor upon activation of said actuating doors.

* * * * *